US009399251B2

(12) United States Patent
Pospischil et al.

(10) Patent No.: US 9,399,251 B2
(45) Date of Patent: Jul. 26, 2016

(54) METHOD AND APPARATUS FOR MANUFACTURING A GEAR WHEEL WITH STUB TOOTHING

(71) Applicant: SONA BLW PRAZISIONSSCHMIEDE GMBH, Remscheid (DE)

(72) Inventors: Jens Pospischil, Munich (DE); Anton Schmid, Bad Wiessee (DE); Norbert Kotulla, Munich (DE)

(73) Assignee: SONA BLW PRAZISIONSSCHMIEDE GMBH, Remscheid (DE)

( * ) Notice: Subject to any disclaimer, the term of this patent is extended or adjusted under 35 U.S.C. 154(b) by 183 days.

(21) Appl. No.: 14/348,265

(22) PCT Filed: Sep. 22, 2012

(86) PCT No.: PCT/EP2012/003968
§ 371 (c)(1),
(2) Date: Apr. 23, 2014

(87) PCT Pub. No.: WO2013/045064
PCT Pub. Date: Apr. 4, 2013

(65) Prior Publication Data

US 2014/0223985 A1 Aug. 14, 2014

(30) Foreign Application Priority Data

Sep. 29, 2011 (DE) ..... 10 2011 114 504

(51) Int. Cl.
*B21K 1/30* (2006.01)
*B21J 5/12* (2006.01)

(52) U.S. Cl.
CPC ..... *B21K 1/30* (2013.01); *B21J 5/12* (2013.01)

(58) Field of Classification Search
CPC ..... B21K 1/30; B21J 5/02; B21J 5/08; B21J 5/12
See application file for complete search history.

(56) References Cited

U.S. PATENT DOCUMENTS 6,536,257 B2 * 3/2003 Nishigori ..... B21J 5/12 29/893.34

FOREIGN PATENT DOCUMENTS

| | | |
|---|---|---|
| DE | 2040413 | 2/1971 |
| EP | 1147835 | 10/2001 |
| JP | 2-258130 | 10/1990 |
| JP | 7-71566 | 3/1995 |

OTHER PUBLICATIONS

International Search Report dated Jan. 22, 2013, from the corresponding PCT/EP2012/003968.

* cited by examiner

*Primary Examiner* — Debra Sullivan
(74) *Attorney, Agent, or Firm* — Katten Muchin Rosenman LLP

(57) ABSTRACT

A method of manufacturing a gear wheel with stub toothing for a change-speed gearbox includes drop-forging a gear wheel body and forming the stub toothing by cold die-grooving in the forging die using a forming tool with forming parts which are arranged in a fan-shaped manner. The forming ends penetrate into the tooth spaces, wherein the forming parts are guided jointly between an upper and a lower receiving plate and are moved in a direction radially inwards in such a way that material is displaced out of the region of the tooth flanks into the tooth root regions.

10 Claims, 4 Drawing Sheets

METHOD AND APPARATUS FOR MANUFACTURING A GEAR WHEEL WITH STUB TOOTHING

BACKGROUND OF THE INVENTION

1. Field of the Inventions

The present invention is directed to a method and apparatus for manufacturing a gear wheel with stub toothing, wherein a gear-wheel body is drop-forged in a first forming step and the stub toothing is finish-swaged in at least one further forming step by cold die-grooving by means of a swaging tool having swaging parts disposed in a fan-like pattern, wherein the swaging ends plunge into the inter-tooth spaces.

2. Description of the Related Art

According to a known method (DE 2040413) for manufacturing a stub toothing on a gear wheel of a gearbox, it is provided that a partial toothed gear with stub toothing is manufactured separately then is welded together with the part of the gear wheel supporting the drive toothing. During the manufacture of the stub toothing of the partial toothed gear, the teeth of the stub toothing are first manufactured with tooth flanks oriented in parallel by die-pressing. This is followed by numerous forming steps by cold grooving up to finishing of the exact tooth shape of the stub toothing. This involves the formation of a roof-like shape in the region of the tooth tip as well as an undercut in the region of the tooth flanks, for which a special beveling apparatus is provided with swaging parts plunging in a fan-like pattern into the interstices of the stub toothing. The individual swaging parts are mounted pivotally and with their inwardly pivoted ends bring about grooving of the inter-tooth spaces.

As a consequence of the numerous machining operations, the known method leads to high manufacturing costs. During machining of the stub toothing by the pivoting swaging parts, overlaps are produced during material forming, potentially leading to malfunctions during subsequent operation.

SUMMARY OF THE INVENTION

In contrast, the object underlying the present invention is to avoid the disadvantages of the known manufacturing method in an apparatus and in a method of the type mentioned in the introduction, and in particular to enable the manufacture of a stub toothing on gear wheels that is characterized by improved accuracy of the stub toothing and ensures long-lasting use without malfunctions. An objective for the manufacturing method as such is to permit a high production rate with long service lives of the die components.

This object is achieved according to the invention with a method of the type mentioned in the introduction, wherein the swaging parts of the swaging tool are guided together between an upper and a lower holding plate and are moved radially inward in a direction such that precise formation of the teeth of the stub toothing is achieved by cold grooving, in which material flows from the region of the tooth flanks into the regions of the tooth roots. In the process, a stub toothing with high accuracy of shape of both the actual tooth shape and of the inter-tooth spaces is produced by material forming.

As a consequence of the material forming achieved with the inventive method, the hollow profile of the die becomes completely filled in the region of the tooth tips. Because of the sharp-edged structure of the lower edges of the roof-like faces achieved thereby in the region of the tooth tips—in connection with the undercut of the tooth flanks—gearing errors caused by axial separation of the shifted drive connection and known as gear jumpers are reliably avoided.

A particularly advantageous configuration is one in which the direction of plunging of the swaging parts of the swaging tool is selected to be oblique relative to the root space of the teeth, so that excess material after complete filling of the hollow profile of the die flows into a cavity of the die adjoining the root space.

In this way, it is possible to avoid the overlapping of the material that occurs as a consequence of cold forming with only superficial displacement of material and that is recognized as disadvantageous.

In order to guarantee precise operation of the swaging parts, it is proposed according to the invention that the gear-wheel body be pressed under a spring-loaded hydraulic force against the upper holding plate during cold grooving, while the swaging parts are pushed inward against a stop between the upper and lower holding plates. These two holding plates are axially fixed by the spring-loaded pressing action.

The kinematics of the displacement of the swaging parts has a definitive influence on the accuracy of tooth formation. Advantageously they are displaced simultaneously and uniformly by means of a vertically movable actuating ring via mutually engaging conical pressure faces on swaging parts and actuating ring, so that the swaging ends of the swaging parts are always forced inward into the inter-tooth spaces under constant conditions. In this regard, close-tolerance guidance of the swaging parts between upper and lower holding plate is particularly advantageous.

In a method variant that is particularly suitable with respect to service life of the die on the one hand and precision of the manufactured stub toothing on the other hand, the stub toothing is produced in two grooving steps, wherein the teeth of the stub toothing are swaged with axially parallel tooth flanks in a first grooving step and are finish-grooved in a second grooving step, in which the swaging parts of the swaging tool produce an undercut of the tooth flanks followed by root rounding.

These two grooving steps are preceded by drop-forging of the stub toothing as the first forming step. In this process, the stub toothing can be extensively manufactured in finished condition in terms of the roof-like form of the teeth in the tip region, and so the later forming work by the subsequent grooving steps can be limited to a minimum in the interests of increasing the accuracy of shape and the service life of the dies.

The tooth flanks of the stub toothing, having been forged to be axially parallel at first, are advantageously given their undercut only by the grooving step using the fan-shaped swaging tool.

In an apparatus for implementing the inventive method, it is provided that the swaging parts of the swaging tool are individual flat pushing parts, which are disposed circumferentially in axial planes relative to the axis of the die at angular intervals corresponding to the circumferential pitch of the stub toothing.

According to a further proposal of the invention, a displacement of the pushing parts with high accuracy can be achieved by guiding the pushing parts between an upper and a lower holding plate of the die and displacing them radially inward in a direction from a starting position to an end position corresponding to the finished tooth shape.

In this regard it is advantageously provided that the gear-wheel body is mounted in such a way in the die that the stub toothing together with the tooth tips points downward. In a further configuration of the inventive apparatus, it is provided that the displacement of the pushing parts is directed obliquely relative to the axis of the die, approximately toward the root region of the stub toothing. A suitable obliqueness of the pushing direction ranges between 5° and 20°, preferably between 10° and 15° and particularly preferably is approximately 12°. For this purpose, the pushing parts are moved both radially and axially until they reach a radially inner stop position.

With the objective of a process workflow that is as free of vibrations as possible and largely uninfluenced by bending forces, it is further proposed according to the invention that the upper and lower holding plates be securely connected to one another and that they define guides for holding the pushing parts, and that—in a further configuration—the lower holding plate end at its radially inner side with a collar part, which points toward the gear-wheel body and the radially outer circumferential face of which acts as a stop in the end position of the pushing parts.

The collar part offers the additional advantage that its upper side can be used as a seat to support a ring-shaped projection of the gear-wheel body, in other words as the static part of the die.

In this way it is possible to create a die structure with which the objective of the present invention can be optimally achieved in view of the special cross-sectional shape of the respective gear wheel.

Particularly advantageously, the pushing parts can be actuated by an actuating ring encircling the swaging parts externally such that, when it is moved vertically, the pushing parts can be displaced via mutually engaging conical pressure faces on pushing parts and actuating ring into their end position in contact with the circumference of the collar part.

BRIEF DESCRIPTION OF THE DRAWINGS

An exemplary embodiment of the invention will be explained hereinafter on the basis of the drawing, wherein.

DETAILED DESCRIPTION OF THE INVENTION

Figure 1:
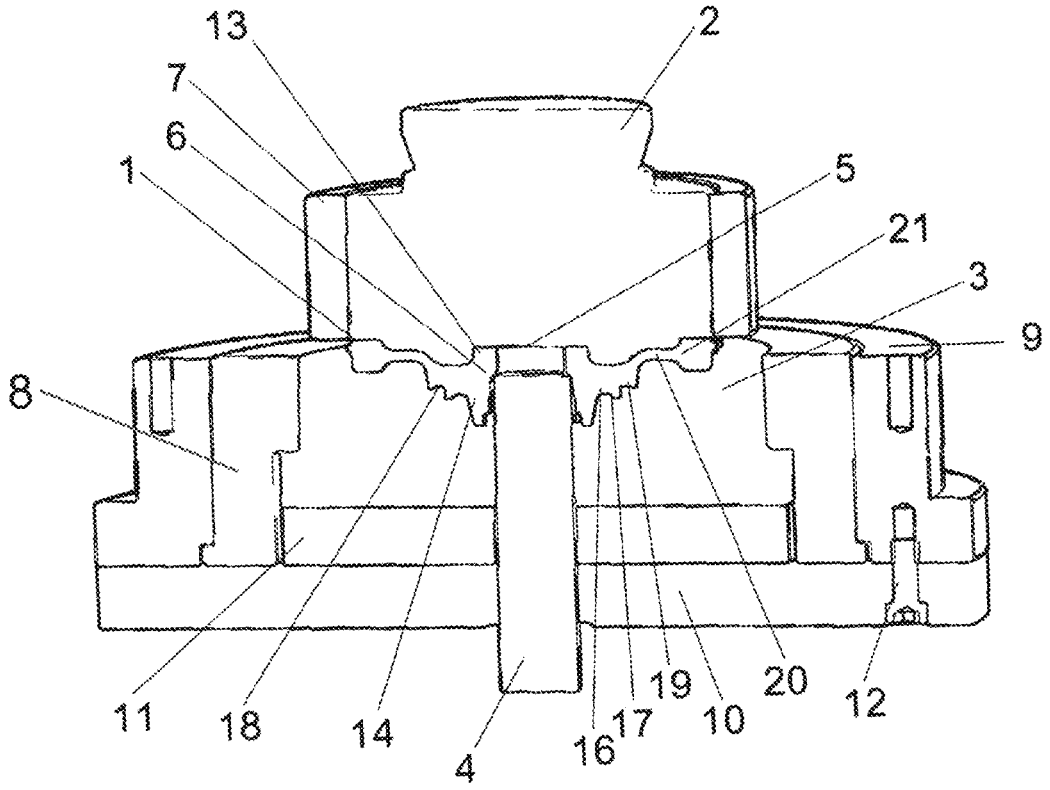
FIG. 1 shows an axial section through a first grooving die

FIG. 1 shows the structure of a first grooving die for grooving the stub toothing of a gear wheel for a gearbox.

Figure 2:
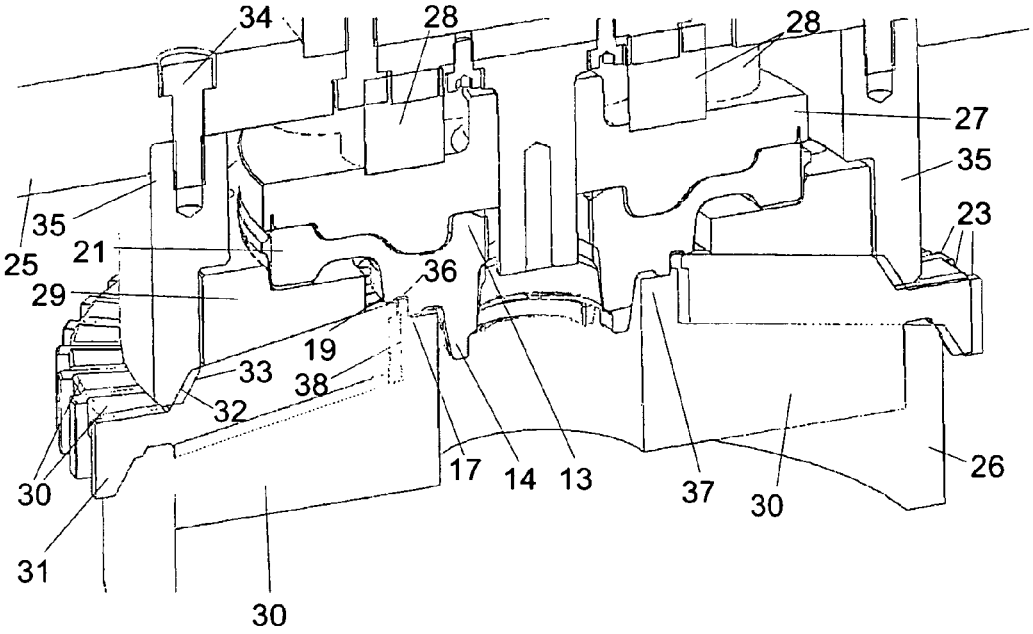
FIG. 2 shows an axial section through a second grooving die

In this forming step, which is followed by a second grooving step as illustrated in FIG. 2, a gear-wheel body 1 forged in an upstream forging die is placed in the first grooving die. In the process, the teeth of the stub toothing already formed in the forging die (not illustrated) are improved with regard to their accuracy of shape. Besides high dimensional accuracy of the radial dimensions, this improvement consists in particular of imparting a precise roof-like shape with sharply structured roof-like edges 40 to teeth 15 (see FIG. 4) in the region of tooth tip 22. The tooth flanks on both sides of each tooth 15 run parallel to one another from the tooth tip to the tooth root, and so the teeth have a constant tooth width over their entire length after the first forming step of cold grooving in the first grooving die according to FIG. 1.

From top to bottom, the die structure according to FIG. 1 comprises a hold-down member 2, which is seated on gear-wheel body 1, which in turn is received from below in female part 3 of the lower die. An ejector 4 engages with its upper end in middle bore 5 of gear-wheel body 1, by the fact that it is received with a circumferential rim 6 of its end face in an enlargement of middle bore 5.

Hold-down member 2 and female part 3 are each fitted inside cylindrical housing parts. In this way, hold-down member 2 is guided inside a guide ring 7 and female part 3 is fixed inside a first die ring 8, which in turn is seated inside an outer die ring 9 and is connected by means of bolts 12 with a base plate 10. A die plate 11 mounted on base plate 10 engages in inner die ring 8, on which female part 3 is mounted.

Gear-wheel body 1 has a hub part 13 encircling its middle bore 5 and ending downward with a conical part 14. During shifting of the gear wheel, the outer cone of conical part 14 functions to adapt the speed of rotation of a clutch sleeve to that of the gear wheel by means of a synchronizing ring, the inner cone of which climbs on outer cone 41 of conical part 14. Outer cone 41 of conical part 14 is clearly illustrated in FIG. 4 on a gear wheel 1 with finish-swaged stub toothing 15.

Figure 4:
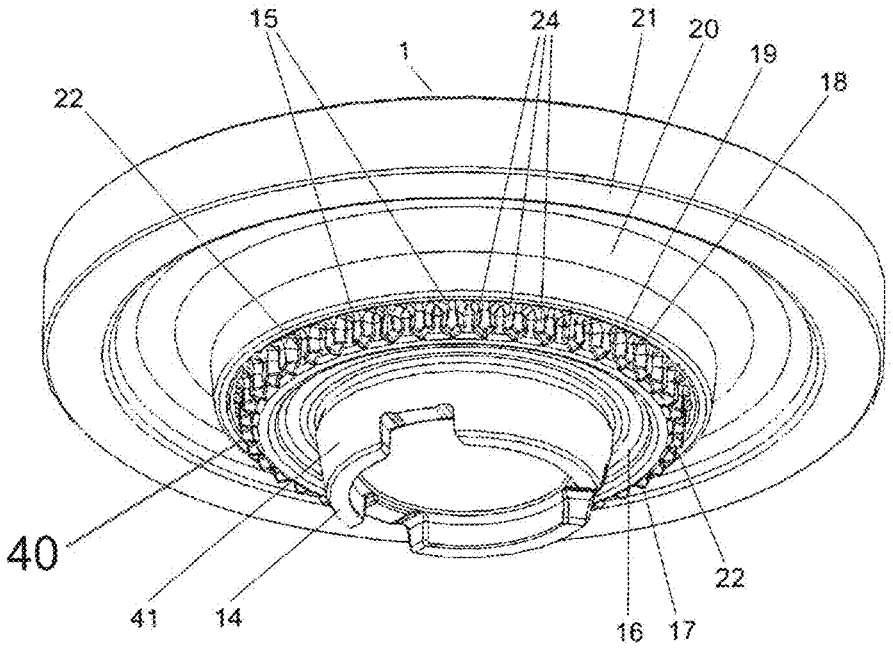
FIG. 4 shows a perspective view of the gear wheel after finishing of the stub toothing

A toothing body 17, on the outer circumference of which stub toothing 15 is formed as illustrated in FIG. 4, is connected to conical part 14 of hub part 13 in radially outward direction via a spacer channel 16. Further outward in radial direction, a stop ring 19 (see FIG. 4), which limits the axial movement of the clutch sleeve, is connected to toothing body 17 outside stub toothing 15 via a narrow spacer channel 18. Yet further outward in radial direction, the outer toothed-gear body 21, which is intended for the drive toothing of the gear wheel still to be produced by chip-removing processes, is connected only beyond a relatively broad spacer channel 20. By means of the grooving die illustrated schematically in FIG. 1, it is possible to form the stub toothing of the forged gear-wheel body precisely, both in the region of roof-like tooth tips 22 (see FIG. 4) and in the region of the tooth flanks, which albeit still have parallel tooth flanks there at first. The obliqueness thereof (shown in FIG. 4), together with corresponding expansion of the inter-tooth spaces toward the respective tooth roots, will first be generated in the second grooving step by use of a swaging tool with swaging parts disposed in a fan-like arrangement, as illustrated in FIG. 2. By means of this swaging tool 23, which substantially constitutes the lower die of the grooving die according to FIG. 2, oblique tooth flanks are generated, as illustrated in FIG. 4 on the finished stub toothing. This undercut of teeth 15 of the stub toothing in the region of their side flanks 24 serves to prevent gear jumpers. Swaging tool 23, as will be further described in detail hereinafter, is provided for machining the interstices of the stub toothing in such a way that material from the region of the tooth flanks will flow by appropriate material flow from the tooth flanks into the hollow profile of the die in the direction of the tooth-root region, and therefore toward spacer channel 18.

Between a pressure plate 25 of the upper die and an outer bracing ring 26 of the lower die, the grooving die according to FIG. 2 comprises a hold-down member 27, which is pressed down by pressure plate 25 by means of elastomeric compression springs 28. Hold-down member 27 is configured in such a way with its lower swaging face that it engages over the entire surface with the shape of gear-wheel body 1 and in this way holds gear-wheel body 1 together with its outer toothed-gear body 21 in contact with an upper holding plate 29. Upper holding plate 29 is connected securely with a lower holding plate 30, in which guides to permit a radial displacement movement of pushing parts 31 are machined. In their radially outer region, pushing parts 31 have pressure faces 33, which project conically upward toward the axis of the die and which cooperate with correspondingly shaped pressure faces 32 of an actuating ring 35 connected to pressure plate 25 via bolts 34. Corresponding to this, pushing parts 31 are pushed inward in radial direction when actuating ring 35 travels downward together with pressure plate 25 until hold-down member 27 reaches its lower end position by means of springs 28. At their inner end, pushing parts 31 each have a swaging end 36, which in the inner position of pushing parts 31 brings about swaging of the inter-tooth spaces, by plunging into them and causing undercutting of the stub toothing in the flank region of the teeth. Each pushing part 31 is used for formation of only one inter-tooth space, which is bounded by the two flanks of adjacent teeth. This plunging by pushing parts 31 is achieved by guiding them precisely between upper holding plate 29 and lower holding plate 30, thus ensuring that an exact tooth shape will be created. Because of the high accuracy of shape of the stub toothing generated in the preceding grooving step according to FIG. 1, it is possible to limit the load of the swaging tool in the second grooving step in favor of a long service life thereof. The exact inner end position of the pushing parts is assured by a stop, which is formed on lower holding plate 30. For this purpose, lower holding plate 30 ends at its radially inner side with a collar part 37, which points toward gear-wheel body 1 and the radially outer circumferential face 38 of which acts as a stop in the inner end position of pushing parts 31.

Figure 3:
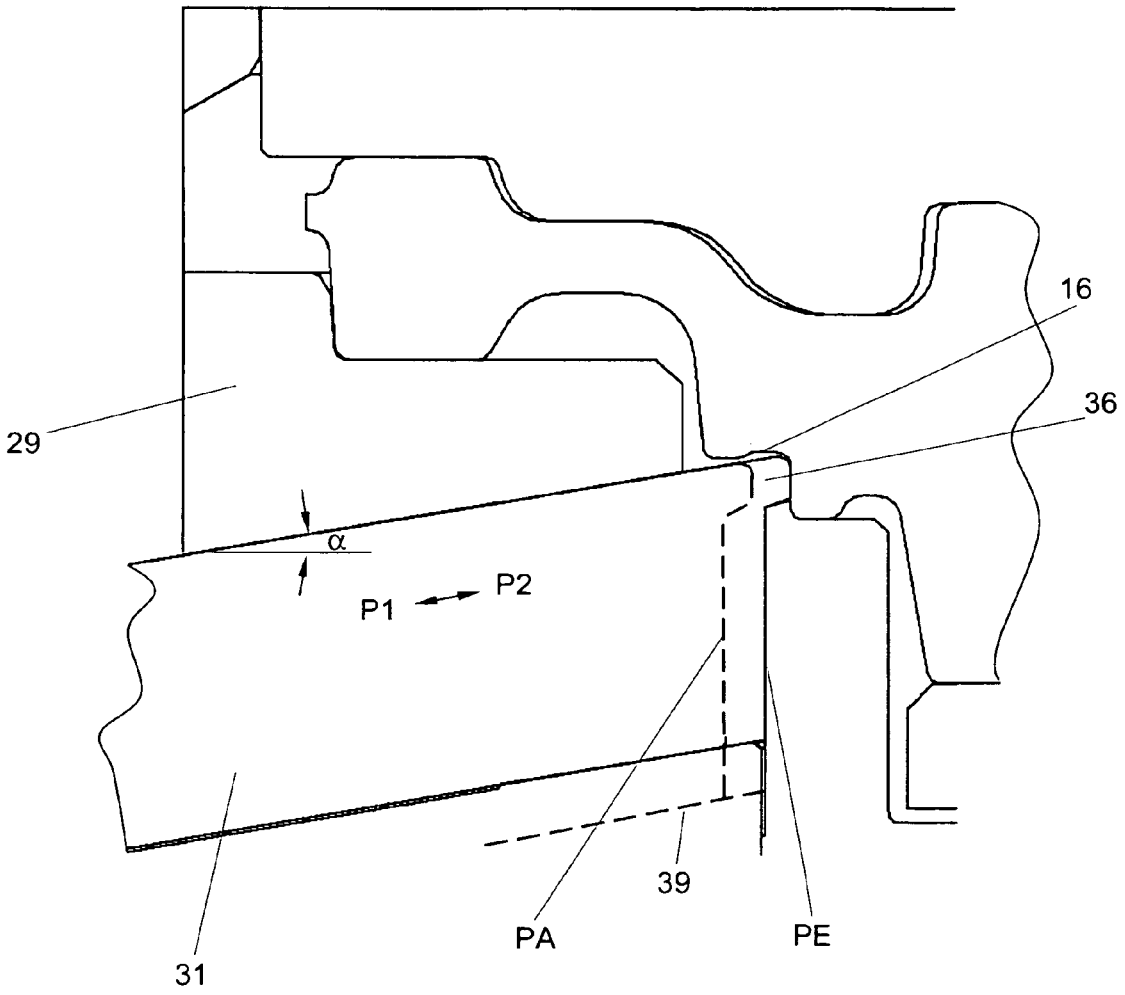
FIG. 3 shows an enlarged partial view of FIG. 2.

It is particularly advantageous to guide pushing parts 31 in such a way that they are angled obliquely relative to the axis of the die during their shape-imparting radial movement toward it, so that the material flow in the region of the inter-tooth spaces takes place upward toward the tooth-root region, where the excess material from the tooth flanks can flow into the tooth-root region and possibly into an adjacent unoccupied cavity of the die thereabove, located underneath spacer ring 16 (FIG. 3).

The obliqueness of the pushing direction of pushing parts 31 advantageously ranges between 5° and 20°, or is approximately 12° in the example of the grooving die illustrated in FIG. 2.

Besides its function as the inner end stop for pushing parts 31, collar 37 of lower holding plate 30 together with its upper end face functions as the support for toothing body 17 of gear-wheel body 1, so that disturbing vibrations in the engaging region of swaging ends 36 of pushing parts 31 are avoided.

The schematic detail of FIG. 2 shown in FIG. 3 illustrates a pushing part 31 in two positions of its inner edge, namely in dashed representation in the retracted starting position PA and as solid lines in its shape-imparting end position PE. This limits the inwardly directed pushing movement along arrow P2, in which swaging end 36 of pushing part 31 plunges to the maximum into an inter-tooth space and in doing so creates the final shape of the space between two adjacent teeth. Above swaging end 36, namely between its upper contour and the adjacent spacer channel 16, a narrow cavity, into which excess material formed during shaping of the inter-tooth space can flow without leading to material overlaps, is present in the die. This favorable displacement direction of the material is achieved by the fact that the pushing part is guided such that it can move obliquely upward toward the axis of the die, so that material displacement necessarily takes place in the explained direction into the tooth-root region and possibly also into spacer channel 16.

FIG. 3 also illustrates the axial extent of pushing part 31, namely up to lower edge 39, which rests in a slot in lower holding plate 30 and is mounted displaceably within this slot. The end position PE of the pushing part shown in FIG. 3 corresponds to its illustration in FIG. 2, right side. The retracted position PA shown as dashed lines in FIG. 3 corresponds to the illustration of pushing part 31 according to FIG. 2, left side.

The fixation of upper holding plate 29 on lower holding plate 30 is not illustrated in more detail in the drawing. Upper holding plate 29 is designed as a continuous annular plate, which with its underside limits the upward guidance of pushing parts 31 in such a way that pushing parts 31 are guided on all sides.

After the die has been opened, and therefore when the pushing parts are retracted to their starting position PA and pressure plate 25, on the underside of which actuating ring 35 is fixed, has been raised, the gear wheel together with finish-swaged stub toothing can be removed upward from the lower die, as illustrated in FIG. 4. At that time tooth tips 22 of the stub toothing point downward. Thereafter the drive toothing is machined into toothed-gear body 21 in a chip-removing process. It is self-evident that the outer circumference of toothed-gear body 21 together with the middle bore of the gear wheel and conical part 14 will have been machined centrally beforehand.

The invention claimed is:

1. A method for manufacturing a gear wheel for use in a gearbox, the gear wheel comprising a finish-swaged stub toothing;

the method comprising the steps of:

(a) drop-forging a gear-wheel body having an initial stub toothing, the initial stub-toothing comprising a plurality of teeth and a plurality of inter-tooth spaces, each tooth having a tooth flank and a tooth root, and respective adjacent teeth being separated by a respective inter-tooth space of the plurality of inter-tooth spaces;

(b) holding the gear-wheel body between an upper holding plate and a lower holding plate;

(c) subsequent to step (a), cold die-grooving the initial stub toothing using a swaging tool to transform the initial stub-toothing into the finish-swaged stub toothing the swaging tool comprising a plurality of swaging parts disposed in a fan-like pattern and a plurality of swaging ends, each swaging part having a respective swaging end, the cold-die grooving being performed by guiding the plurality of swaging parts together between the upper holding plate and the lower holding plate, and moving, in a pre-determined direction, the plurality of swaging parts radially inward and plunging, in the pre-determined direction, the plurality of swaging ends into the inter-tooth spaces to precisely form the plurality of teeth, wherein excess material flows from the tooth flanks into the tooth roots;

wherein the pre-determined direction is oblique to the tooth root for flowing material after complete filling of a hollow profile of a die flows into a cavity of the die adjoining a region of the tooth roots.

2. A method according to claim 1, further comprising the step of during step (c) pressing the gear-wheel body under a spring-loaded hydraulic force against the upper holding plate and pushing the swaging parts inward against a stop between the upper and lower holding plates.

3. A method according to claim 1, further comprising the steps of forcing the swaging parts together with their swaging ends using a vertically movable actuating ring via mutually engaging conical pressure faces on the swaging parts and the actuating ring into the inter-tooth spaces.

4. A method according to claim 1, further comprising a first grooving step comprising swaging the stub toothing with parallel tooth flanks;

a second grooving step comprising finish grooving by undercutting tooth flanks using the swaging parts of the swaging tool produce and rounding the tooth root.

5. An apparatus for manufacturing a gear wheel for use in a gearbox, the gear wheel comprising a finish-swaged stub toothing, the stub toothing comprising a plurality of teeth separated by respective inter-tooth spaces, the apparatus comprising:

a swaging tool comprising a plurality of swaging parts disposed in a fan-like pattern and a plurality of swaging ends, each swaging part having a respective swaging end, the swaging ends plunge into the inter-tooth spaces; and the swaging parts of the swaging tool being individual flat pushing parts disposed circumferentially in axial planes relative to an axis of a die at angular intervals corresponding to a circumferential pitch of the finish-swaged stub toothing;

the pushing parts are guided between an upper and a lower holding plate and are radially inward displaceable in a direction from a starting position to an end position (PE) corresponding to a shape of the finish-swaged stub toothing;

wherein the pushing parts comprises a displacement that is oblique relative to the axis of the die and directed toward the root region of the stub toothing.

6. An apparatus according to claim 5, wherein the displacement is between 5° and 20°.

7. An apparatus according to claim 5, wherein the upper and lower holding plates are securely connected to one another and define guides for holding the pushing parts.

8. An apparatus according to claim 5, further comprising a collar part, wherein the lower holding plate comprises a radially inner side, the radially inner side defining an end of the lower holding plate, the radially inner side being proximate to the collar part, the collar part pointing toward the gear-wheel body and the radially outer circumferential face of the collar part acts as a stop in the end position of the pushing parts.

9. An apparatus according to claim 8, wherein a ring-shaped projection of the gear-wheel body is seated on the upper side of the collar part of the lower holding plate.

10. An apparatus according to claim 5, further comprising a vertically movable actuating ring, the pushing part having a first conical pressure face and the vertically movable actuating ring having a second conical pressure face, wherein the pushing parts are displaceable into their end position by the first conical pressure face engaging the second conical pressure face.

* * * * *